US009241563B2

(12) United States Patent
Katz

(10) Patent No.: US 9,241,563 B2
(45) Date of Patent: Jan. 26, 2016

(54) ATTACHABLE MUSIC BOOK HOLDER

(71) Applicant: Pablo Reuben Katz, Nr. Taunton (GB)

(72) Inventor: Pablo Reuben Katz, Nr. Taunton (GB)

(73) Assignee: KATZKLIP COMPANY LIMITED, Milverton (GB)

( * ) Notice: Subject to any disclaimer, the term of this patent is extended or adjusted under 35 U.S.C. 154(b) by 0 days.

(21) Appl. No.: 13/965,349

(22) Filed: Aug. 13, 2013

(65) Prior Publication Data

US 2014/0041505 A1 Feb. 13, 2014

(30) Foreign Application Priority Data

Aug. 13, 2012 (GB) ..... 1214427.5

(51) Int. Cl.

| | |
|---|---|
| ***G10D 9/00*** | (2006.01) |
| ***A47B 23/06*** | (2006.01) |
| ***B42D 9/00*** | (2006.01) |
| ***G10C 3/00*** | (2006.01) |

(52) U.S. Cl.

CPC . *A47B 23/06* (2013.01); *B42D 9/00* (2013.01); *G10C 3/00* (2013.01); *Y10T 29/49826* (2015.01)

(58) Field of Classification Search

USPC ..... 84/453, 486–496; 248/451

See application file for complete search history.

(56) References Cited

U.S. PATENT DOCUMENTS

| | | | | |
|---|---|---|---|---|
| 4,047,688 | A | | 9/1977 | Knox et al. |
| 5,088,677 | A | * | 2/1992 | Chandler et al. ..... 248/451 |

FOREIGN PATENT DOCUMENTS

| | | | | | |
|---|---|---|---|---|---|
| CN | 201769477 | U | | 3/2011 | |
| FR | 2640332 | A1 | | 6/1990 | |
| GB | 191008522 | A | | 0/1911 | |
| GB | 191110517 | A | | 0/1912 | |
| GB | 191110517DA | | * | 0/1911 | ..... B42D 9/00 |
| GB | 167717 | A | | 8/1921 | |
| JP | 8039964 | A | | 2/1996 | |
| JP | H0839964 | A1 | | 2/1996 | |
| JP | 2001287480 | A | | 10/2001 | |
| NL | 8204962 | A | | 7/1984 | |
| WO | 2008140354 | A1 | | 11/2008 | |

OTHER PUBLICATIONS

Search Report for British Application No. GB1214427.5 dated Sep. 26, 2012.

* cited by examiner

*Primary Examiner* — Kimberly Lockett
(74) *Attorney, Agent, or Firm* — King & Schickli, PLLC

(57) ABSTRACT

An attachable book holder is disclosed for a piano having a music rest, where the music rest has upper and lower outer surfaces. The attachable book holder comprises an elongate finger element and an attachment means which is connected to the elongate finger element at a connection point. The attachment means is attachable to at least one of the outer surfaces of the music rest at one or more contact regions. The elongate finger element is adjustable between a first orientation in which the finger element extends upwards from the connection point and a second orientation. The attachable book holder can be used on modern pianos which are supplied without book holders as part of the music rest, or alternatively the attachable book holder can be used to replace faulty or missing book holders on older pianos. In the former case there is no need to drill the casing of the book rest to attach the book holder to the music rest.

17 Claims, 5 Drawing Sheets

ATTACHABLE MUSIC BOOK HOLDER

Figure 1:
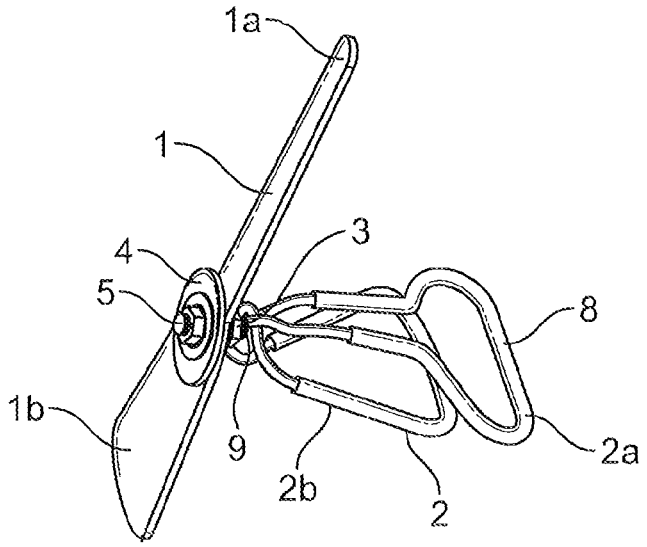

This invention relates to an attachable music book holder for use with pianos, although the invention is not limited to such and the music book holder may be attached to other musical instruments whose book holders have become broken or missing or even music stands.

Until about the 1960's new upright pianos were supplied with book holders which were attached to the music rest of the piano by screwing the book holders into previously drilled holes located in the music rest. The music rest element enables a music book to be securely positioned on the music rest and the book holder allows pages to be fixed in the desired place. The screwable book holder is never intentionally removed from the music rest by the owner of the piano but can become faulty and may become detached from the music rest and misplaced. For this reason, separate screw-in book holder elements are made available to purchase so as to replace a faulty or missing book holder element of the pre-1960 designs.

In more recent years, modern upright pianos are supplied without book holders as part of the music rest. A common problem caused by the lack of book holders on the music rest is that pages of the books do not remain in place as desired. Also the positioning of music books on the music rests can be somewhat precarious with the books being prone to falling off of the music rest and, in the worst case, onto the keys of the piano or the floor. Such a situation is extremely distracting and inconvenient for the pianist.

It is known for people to fit the traditional book holders on their modern piano so as to alleviate the above-mentioned problems; however this is not always possible or a convenient solution since the screw holes must be drilled into the book rest of the modern piano, and the shape and/or material of the modern piano music rest (e.g. a plastics material or a man made composite material comprising a shell formed from a plastics material) does not lend itself well to such a procedure. Therefore it is generally required for a specialist technician to drill the hole so as not to damage the piano. Even so, if possible the procedure can be problematic, and there is a risk that the piano may be damaged. Also, the time and/or expense to the owner of the piano in preparing the piano to receive the traditional book holder can be significant. Further, considering the cost associated with the purchase of the piano, it may be undesirable for the owner to drill holes in the casing of the piano.

As an alternative to drilling screw holes in the piano, so as to enable the receipt of traditional book holders, the original music rest may be replaced with a music desk or music tray containing pre-fitted music holders. Such a music tray may be fixed to the piano at the position of the original music rest using the existing hinges, or new hinges with screws in the existing screw holes. This can be inconvenient to fix into position and could lead to marking of the outer casing if not carried out with care. Once in position, the replacement music tray or desk could be intrusive to the aesthetics of the piano since the surface finish may not precisely match that of the piano. Further the music tray is not easily transportable and is non-universal since it is to be permanently fixed to the piano. In addition there may be a problem with the orientation of the book holders that have not been designed with the shape of a particular fall in mind. The present invention is derived from the realisation that there exists a long felt need to provide a music book holder which can be used with modern pianos and is transportable and convenient to use, whilst adequately providing the roles of holding the music book securely in position and holding pages of the music book in place. There is also a need to provide a low cost solution to the aforementioned problems.

According to the invention there is provided an attachable book holder for a piano having a music rest, the music rest having upper and lower outer surfaces, the book holder including:

an elongate finger element, an attachment means connected to the elongate finger element at a connection point, the attachment means being attachable to at least one of said outer surfaces at one or more contact regions, and wherein the elongate finger element is adjustable between a first orientation in which the finger element extends upwards from the connection point and a second orientation.

With this arrangement the pianist can conveniently attach the book holder to the existing music rest of a piano so as to retain music books or sheet music in the desired position without damaging the casing of the piano or providing an unnecessary force on the music rest. This arrangement is also small in size making it unobtrusive to the aesthetics of the piano and easily transportable for use on multiple pianos. Further the arrangement is universal (in the sense that it can be used with traditional and modern pianos) and removes the need to detach the music book holder before closing the fall.

Preferably, the attachable book holder has a first configuration for receiving at least a portion of the music rest and a second configuration wherein the attachment means attaches to the music rest at the contact regions.

Beneficially, the attachment means includes a first and second jaw element contacting, respectively, the upper and lower outer surfaces of the music rest at the contact regions. In this arrangement there is no requirement for the book holder to be secured within the material of the music rest itself as the outer surface is used to secure the book holder in position.

Preferably, the attachable book holder for a piano includes orientation means for orientating the finger element vertically in the first orientation. This allows the book holder to retain the music book in position when it is placed on the music rest and allows for convenient storage of the book holder when the fall of the piano is to be closed.

Typically, the second orientation is, in use, parallel to the edge of the music rest. Therefore, the second configuration is typically approximately 90° to the first orientation.

Desirably, the finger element is pivotable about the connection point and preferably, the orientation means is provided by the finger element having a bottom heavy end portion and arranged such that the connection point is positioned between the bottom heavy end portion and the other end portion of the elongate finger element.

In a first embodiment, the attachment means is a clip connected to the elongate finger element at the connection point. The clip may include a biasing element to urge the attachment means against the music rest at the contact regions. Desirably, the biasing element is a spring. Alternatively the material used to form the clip may provide the desired biasing effect and the requirement for the spring is therefore obsolete.

In a second embodiment, the attachment means includes a flexible strip connected to the elongate finger element at the connection point. The flexible strip may be an elastomeric strip. The attachment means may further include an adhesive for adhering the attachment means to the music rest.

In a preferred embodiment, the elongate finger element and the attachment means are connected at a connection point by a threaded pin and nut. The nut is adjustable, and when loosened enables the elongate finger element to be adjustable between the first and second orientations, and when tightened enables the elongate finger element to be retained in a fixed orientation. The elongate finger element may, therefore, be fixed in an upright position, in an orientation at an angle to the vertical or may be fixed in the storage position, whereby the elongate finger element is arranged parallel to the edge of the music rest.

In an alternative embodiment, a resilient member is positioned between the elongate finger element and the attachment means such that a force is applied to the elongate finger element by the spring or washer so as to keep the elongate finger element in the desired orientation. The resilient member could be, for example, a spring or a washer.

According to a further aspect of the invention there is included a piano including an attachable book holder of the invention.

Further there is provided a method of attaching a book holder of the invention to the music rest of a piano, the music rest having upper and lower outer surfaces, the method including:

attaching the attachment means to at least one of said outer surfaces of the music rest at one or more contact regions.

Whilst the invention has been disclosed above it extends to any inventive combination of the features set out above, or in the following description, drawings or claims.

Figure 2:
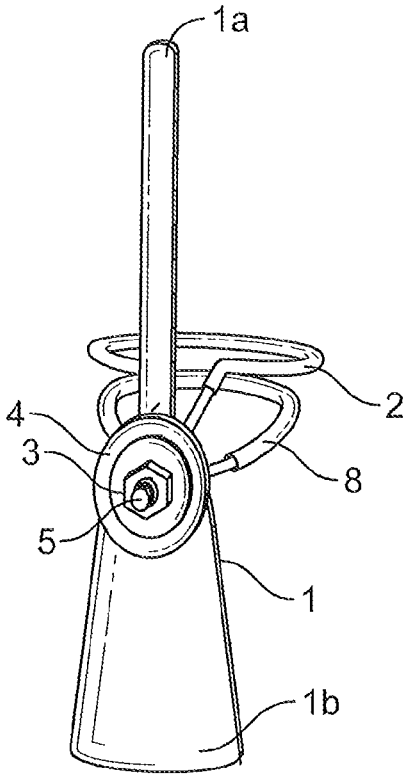
Figure 3:
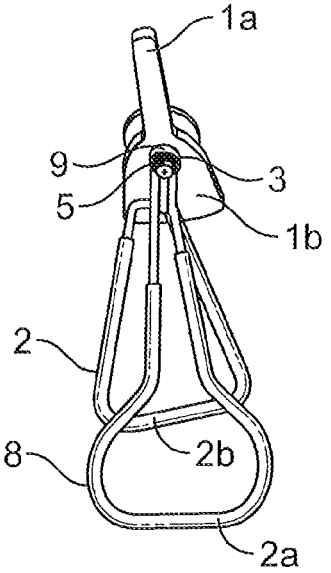
Figure 4:
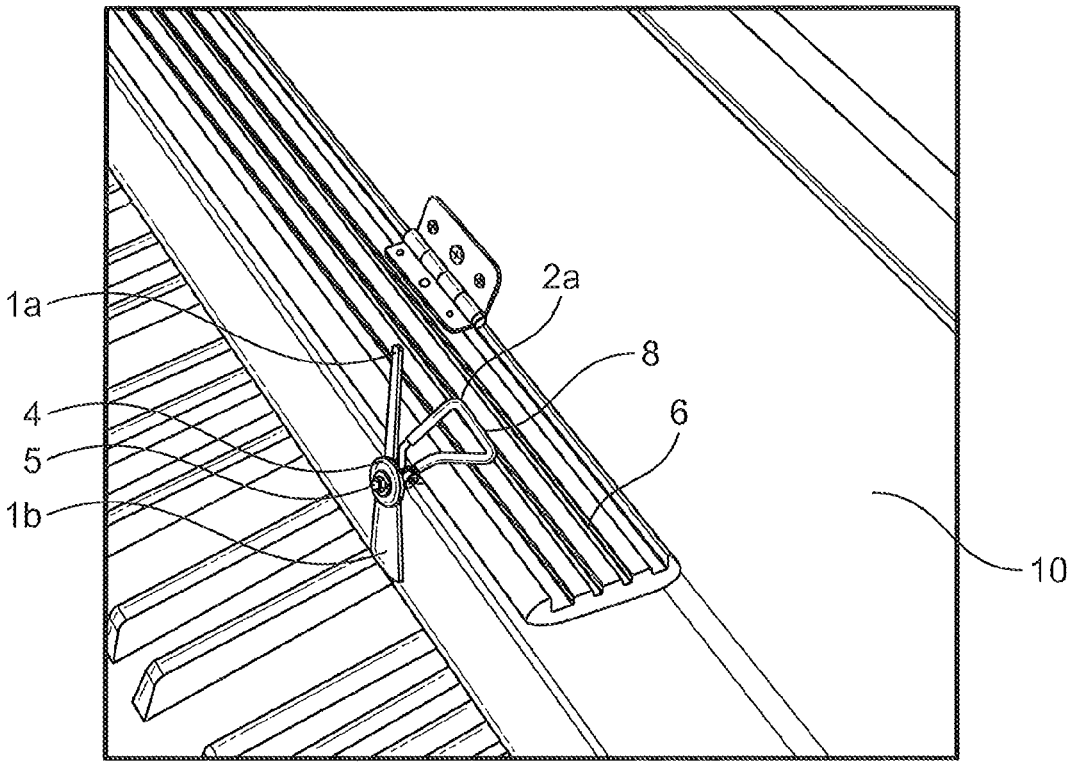
Figure 5:
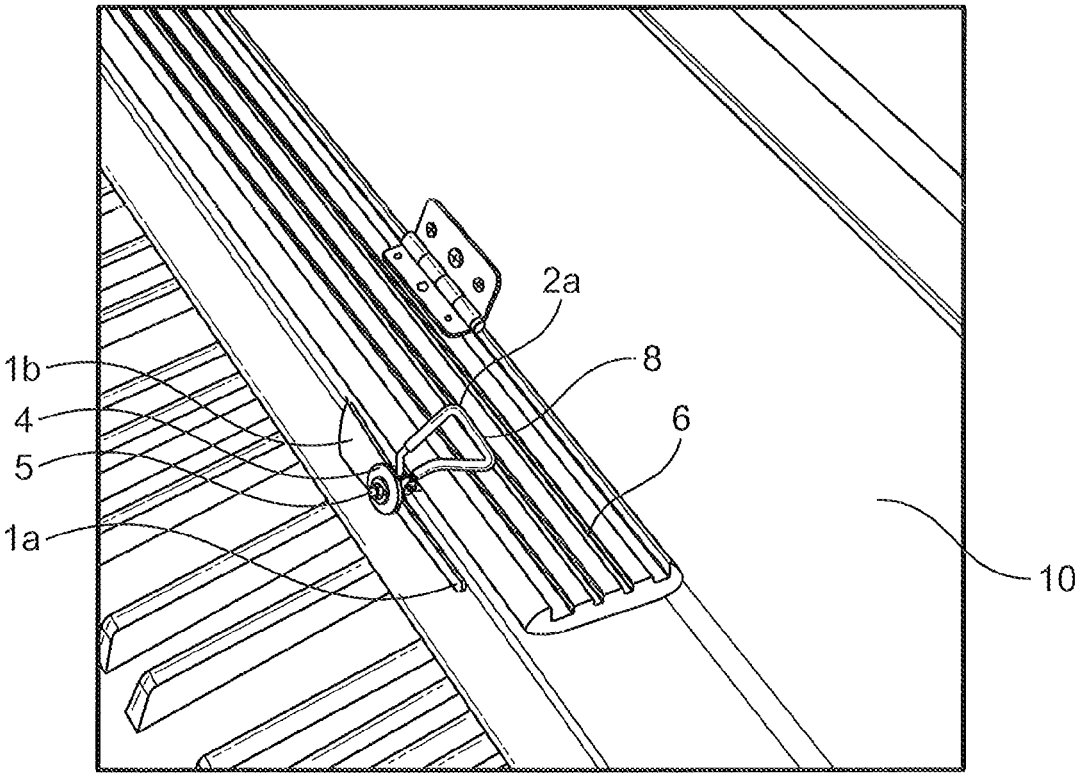
Figure 6:
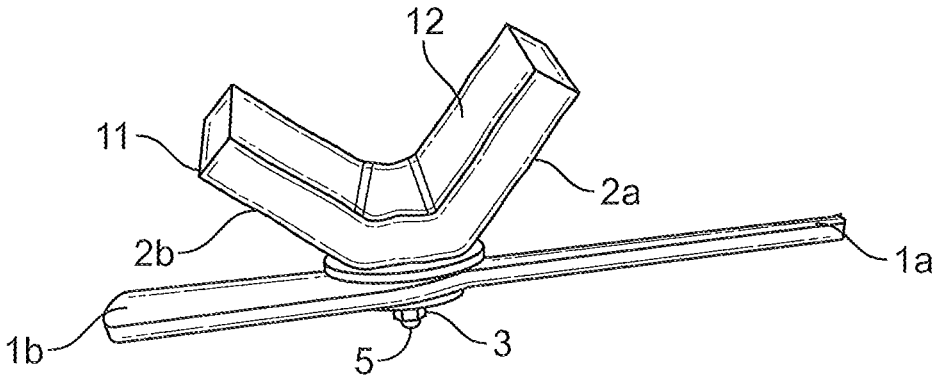
Figure 7:
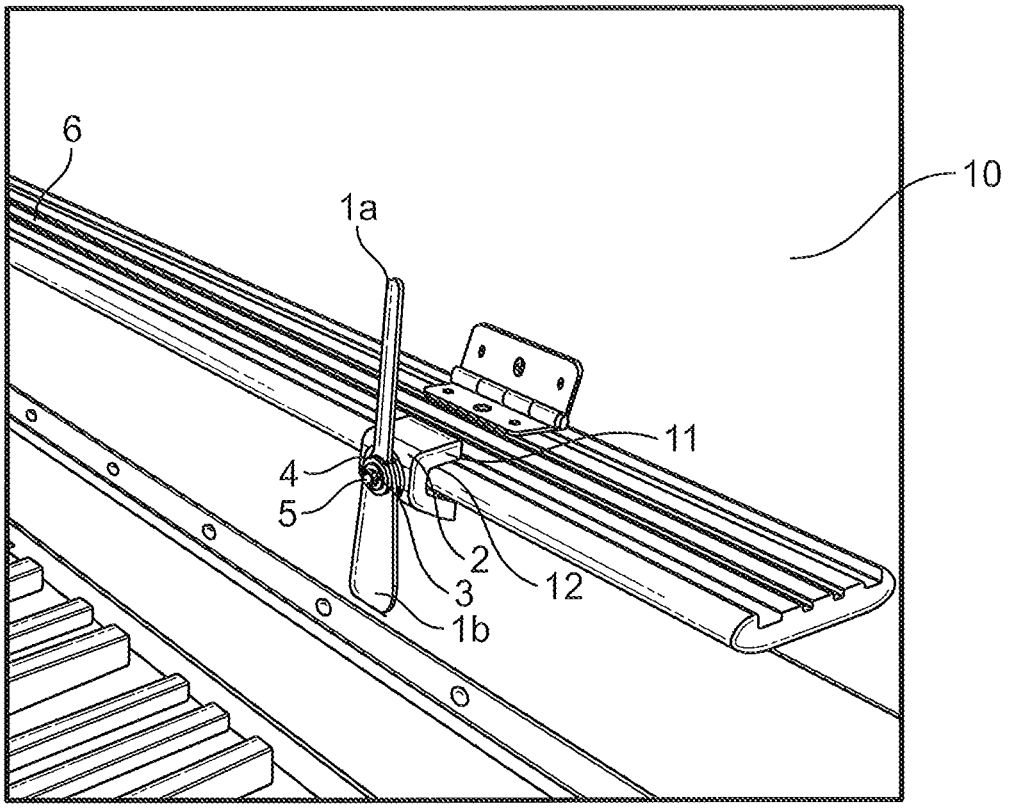
Figure 8:
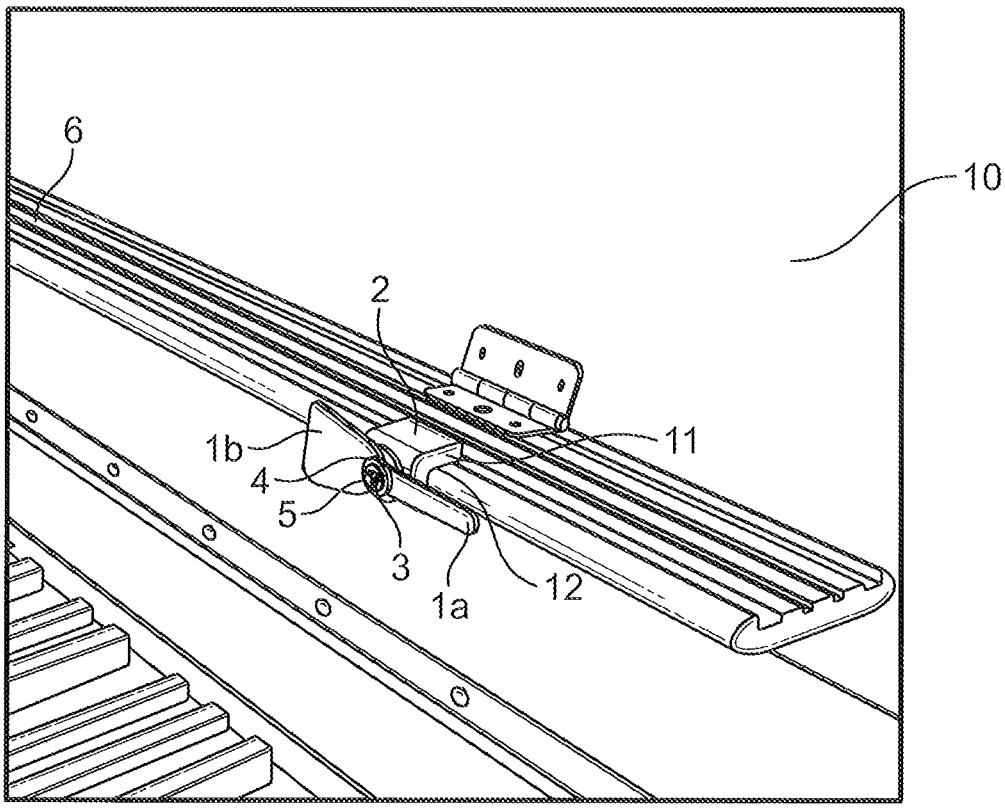

The invention will now be described, by way of example only, with reference to the accompanying drawings in which:

FIG. 1 is a side view of an attachable book holder in accordance with a first embodiment of the invention, FIG. 2 is a front view of the attachable book holder of FIG. 1, FIG. 3 is a back view of the attachable book holder of FIG. 1, FIG. 4 is a perspective view of the attachable book holder of FIG. 1 when deployed, FIG. 5 is a perspective view of the attachable book holder of FIG. 1 when deployed and in the storage position, FIG. 6 is a side view of an attachable book holder in accordance with a second embodiment of the invention, FIG. 7 is a perspective view of the attachable book holder of FIG. 6 when deployed, FIG. 8 is a perspective view of the attachable book holder of FIG. 6 when deployed and in the storage position.

Referring firstly to FIGS. 1 to 5, there is shown an elongate finger element 1 and an attachment means 2 connected by a threaded pin 3 and nut 4 at a connection point 5. When the nut 4 is loosely screwed on the threaded pin 3, but so as not to remove the nut 4 from the pin 3, the elongate finger element 1 is pivotable, or rotatably moveable, about the connection point 5 with the threaded pin 4 acting as an axle. The attachment means 2 and elongate finger element 1 are relatively moveable. The elongate finger element 1 has a first end portion 1*a* extending from the connection point 5 and a wider second end portion 1*b* extending in the opposite direction from the connection point 5. The second end portion 1*b* is bottom heavy so that when the nut 4 is in the loosened position, so as to allow free rotation of the elongate finger element 1 about the threaded pin 3, the elongate finger element 1 is orientated in its first orientation with its longitudinal axis in a vertical or upright position, with the narrower first end portion 1*a* positioned above the connection point 5 and the bottom heavy second end portion 1*b* positioned below the connection point 5. In this arrangement the first end portion 1*a* extends upwards from the attachment means 2 and the connection point 5 is positioned between the bottom heavy second end portion 1*b* and the first end portion 1*a*.

When the nut 4 is tightly fastened to the threaded pin 3 the elongate finger element 1 is retained in a fixed orientation regardless of its orientation. Therefore, the elongate finger element 1 can be secured in a position orientated away from the first orientation, which is the pre-determined biasing orientation, such that the longitudinal axis of the elongate finger element 1 creates an angle with respect to the vertical or upright position. To enable this, the user must loosen the nut 4, rotate the elongate finger element 1 from the vertical orientation (which is the predetermined bias orientation) to the desired orientation and tighten the nut 4 to secure the elongate finger element 1 into this off-vertical orientation. This process can be carried out when the attachment means 2 is deployed.

When deployed, the attachment means 2 is attached to the music rest 6 of a piano 7. The attachment means 2 has two end portions 2*a*, 2*b* extending from the connection point 5. The attachment means has a first configuration for receiving an edge of the music rest 6, where the distance between the two ends of the two end portions 2*a*, 2*b* of the attachment means 2 are increased to a distance greater than the height of the edge of the music rest 6 so as to form a jaw, the two end portions 2*a*, 2*b* forming the first and second jaw elements respectively. The attachment means can then be retained in a second configuration where the inner opposing faces of the two end portions of the attachment means 2*a*, 2*b* come into contact with the upper and lower surface of the music rest 6 at respective contact regions so as to hold the book holder in place on the edge of the music rest 6. The end portions 2*a*, 2*b* of the attachment means 2 can move through a range of angles about the connection point 5 so as to be suitable for a wide variety of music rest edge heights.

FIGS. 1 to 3 show a first embodiment of the invention where the attachment means 2 is a clip 8 connected to the elongate finger element 1 at the connection point 5. The clip 8 is biased in the deployed, or closed, position, also corresponding to the second configuration, by a suitable biasing element such as a spring 9. The spring 9 urges the attachment means against the surface of the music rest 6 at the contact regions. Therefore, the clip 8 and the spring 9 are combined to form a sprung clip.

The clip elements 8*a*, 8*b* are formed of two wire loops and are shaped to follow the surface contours of the music rest 6. The upper or first clip element 8*a* is slightly curved so as to aid grip around any ridges which may be included on the upper surface of the music rest 6. The lower or second clip element 8*b* is longer than the first clip element 8*a* so as to obtain maximum area under the music rest 6. The clip end portions are curved in shape so as to allow the clip ends to follow the contours of the music rest, and in general the total length from the attachment point to the end of the clip portion does not exceed 40 cm and can be of any length which allows for good hold on the music rest. So as to minimise damage to the surface finish of the music rest 6 or the fall 10, the wire elements 8*a*, 8*b* of the clip 8 that would otherwise come into contact with the surface music rest 6 or fall 10 are covered in rubber or plastic.

In use, the sprung clip 8 is attached to the music rest 6 and the elongate finger element 1 is secured in the desired position by means of tightening the nut 4 on the threaded pin 3, as shown in FIG. 4. Sheet music or music books can then be positioned on the music rest 6 in the usual way, but the presence of the attachable music holder ensures that the sheet music or music book remains in position and the book holder also enables pages to be kept in position as they are turned. For this to work the first thinner end of the elongate finger element 1*a* extends upwards, whether at a vertical orientation or a position angled with respect to the vertical.

FIG. 5 demonstrates the book holder in a storage position. When the fall 10 of the piano 7 is to be closed the clip 8 is retained in the deployed or closed position on the music rest 6 and the nut 4 is loosened enabling the user to rotate the elongate finger element 1 to a second orientation in a substantially horizontal position which lies in parallel to the edge of the music rest 6. The nut 3 is then tightened and the elongate finger element 1 is retained in a flattened storage position so as to permit the closure of the fall 10. Such an arrangement minimises or prevents damage to the top of the fall or the piano keys by the book holder.

FIGS. 6 to 8 show a second embodiment of the invention where the attachment means is formed of a flexible strip 11 connected to the elongate finger element 1 at the connection point 5. The flexible strip 11 is made of elastomeric material, e.g. rubber. The flexible strip has a double sided adhesive tape 12 attached to the side of the strip 11 facing away from the elongate finger element 1. In a first position the flexible strip 11 has a first end portion 11 a extending away from the connection point 5 and a second end portion 11 b extending away from the connection point 5. The flexible strip 11 bends about the connection point 5 in a direction away from the elongate finger element 1 such that the adhesive tape 12 of the first end portion 11*a* faces the tape of the second end portion 11*b*. In use, the two end portions 11*a*, 11*b* are placed around an edge of the book rest 6 such that the first end portion 11*a* is stuck to the upper surface of the music rest 6 and the second end portion 11*b* is stuck to the lower surface of the music rest 6 so as to secure the rubber strip in place. This provides a more permanent arrangement compared to the sprung clip 8 of the first embodiment.

Factors such as the shape of the music rest 6 and the required permanency of the attachment can determine whether to use the clip 8 and spring 9 arrangement or the flexible strip 11 and adhesive tape 12 arrangement.

Various modifications to the principles described above would suggest themselves to the skilled person. For example, another form of adhesive e.g. glue may be used in place of the adhesive tape 12 of the second embodiment. Prior to use, the adhesive surface of the book holder may be covered with a release layer. The strip may be made of a material having a deformable property. The biasing effect produced by the shape of the lower portion of the elongate finger element 1 may be provided by a separate element to be attached to the elongate finger element 1.

A resilient member, for example a spring or a washer, can be positioned between the elongate finger element and the attachment means such that the resilient member is arranged to apply a force on the elongate finger so as to maintain the elongate finger element in the required orientation. This eliminates the need for the user to tighten and loosen the threaded pin and nut thereby allowing the threaded pin and nut to stay in a predetermined position of tightness such that the finger can be moved by the user with ease whilst ensuring that when the elongate finger element is released by the user the force asserted by the washer is enough to hold the finger in position. The threaded pin and nut can be tightened further to more securely position the elongate finger when the piano is being transported thereby ensuring vibrations do not cause the elongate finger to rest on the pianos case.

The clip need not be formed of two wire loops and may instead be formed of a single elongate strip of material. The strip of material may be folded to form the upper and lower elements of the clip, whereby the fold portion can be positioned to ensure that the lower clip element is longer than the upper clip element as desired. The connection point is arranged at the outer surface of the fold portion i.e. the end of the clip that is remote from the end portions of the attachment means. The lower and upper clip elements have a curved end as per the loop embodiment so as to enable the clip elements to mold along the contour of the music rest. The material of the clip is chosen to provide the bias effect required to secure the music rest between the upper and lower portions of the clip. The strip of material is made from a metal and the inner surface of the strip need not be flat.

The attachment means may be connected to the elongate finger element by way of a rivet rather than by way of the threaded pin and nut.

The invention claimed is:

1. An attachable book holder for a piano having a music rest, the music rest having upper and lower outer surfaces, the book holder including:

an elongate finger element, an attachment means connected to the elongate finger element at a fixed connection point, the attachment means being attachable to at least one of said outer surfaces at one or more contact regions, and a resilient member positioned between the elongated finger element and the attachment means, wherein the elongate finger element is adjustable between a first orientation in which the finger element extends upwards from the connection point and a second orientation, and wherein the resilient member applies a force to said elongate finger element to retain the elongate finger element in a desired orientation.

2. An attachable book holder for a piano having a music rest according to claim 1 in which the attachment means has a first configuration for receiving at least a portion of the music rest and a second configuration wherein the attachment means attaches to the music rest at the contact regions.

3. An attachable book holder for a piano having a music rest according to claim 1 in which the attachment means includes a first and second jaw element contacting, respectively, the upper and lower outer surfaces of the music rest at the contact regions.

4. An attachable book holder for a piano having a music rest according to claim 1 further including orientation means for orientating the finger element vertically in the first orientation.

5. An attachable book holder for a piano having a music rest according to claim 1 wherein the second orientation is, in use, parallel to the edge of the music rest.

6. An attachable book holder for a piano having a music rest according to claim 1 wherein, the finger element is pivotable about the connection point.

7. An attachable book holder for a piano having a music rest according to claim 1 including orientation means for orientating the finger element vertically in the first orientation, wherein the finger element is pivotable about the connection point and further wherein, the orientation means is provided by the finger element having a bottom heavy end portion and arranged such that the connection point is positioned between the bottom heavy end portion and the other end portion of the elongate finger element.

8. An attachable book holder for a piano having a music rest according to claim 1 wherein the attachment means is a clip connected to the elongate finger element at the connection point.

9. An attachable book holder for a piano having a music rest according to claim 8, wherein the clip includes a biasing element to urge the attachment means against the music rest at the contact regions.

10. An attachable book holder for a piano having a music rest according to claim 9 wherein the biasing element is a spring.

11. An attachable book holder for a piano having a music rest according to claim 1, wherein the attachment means includes a flexible strip connected to the elongate finger element at the connection point.

12. An attachable book holder for a piano having a music rest according to claim 11, wherein the attachment means includes an adhesive for adhering the attachment means to the music rest.

13. An attachable book holder for a piano having a music rest according to claim 1 wherein the attachment means is connected to the elongate finger element at the connection point by a threaded pin and nut.

14. A piano including an attachable book holder according to claim 1.

15. A method of attaching a book holder according to claim 1 to a music rest of a piano, the music rest having upper and lower outer surfaces, the method including:

attaching the attachment means to at least one of said outer surfaces of the music rest at one or more contact regions.

16. An attachable book holder for a piano having a music rest, the music rest having upper and lower outer surfaces, the book holder including:

an elongate finger element, an attachment means connected to the elongate finger element at a fixed connection point, the attachment means being attachable to at least one of said outer surfaces at one or more contact regions, the attachment means including a flexible strip connected to the elongate finger element at the connection point, wherein the elongate finger element is adjustable between a first orientation in which the finger element extends upwards from the connection point and a second orientation.

17. An attachable book holder for a piano having a music rest, the music rest having upper and lower outer surfaces, the book holder including:

an elongate finger element, and an attachment means connected to the elongate finger element at a fixed connection point, the attachment means being attachable to at least one of said outer surfaces at one or more contact regions, wherein the elongate finger element is adjustable between a first orientation in which the finger element extends upwards from the connection point and a second orientation, and wherein the attachment means is connected to the elongate finger element at the connection point by a threaded pin and nut.

* * * * *